US007688285B2

(12) United States Patent
Han

(10) Patent No.: US 7,688,285 B2
(45) Date of Patent: Mar. 30, 2010

(54) DRIVING METHOD OF PLASMA DISPLAY APPARATUS

(75) Inventor: Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 932 days.

(21) Appl. No.: 11/420,134

(22) Filed: May 24, 2006

(65) Prior Publication Data

US 2007/0013309 A1 Jan. 18, 2007

(30) Foreign Application Priority Data

Jul. 13, 2005 (KR) ..... 10-2005-0063493

(51) Int. Cl.
*G09G 3/28* (2006.01)

(52) U.S. Cl. ..... 345/60; 345/204

(58) Field of Classification Search ..... 345/60–63, 345/75.2, 204
See application file for complete search history.

(56) References Cited

U.S. PATENT DOCUMENTS 4,063,131 A 12/1977 Miller
4,492,957 A 1/1985 Marentic
5,517,207 A * 5/1996 Kawada et al. ..... 345/78
6,603,449 B1 8/2003 Kang et al.
2002/0047584 A1 4/2002 Rutherford
2004/0080480 A1 * 4/2004 Zhang et al. ..... 345/90
2004/0155839 A1 * 8/2004 Moon ..... 345/75.2
2005/0264481 A1 * 12/2005 Choi et al. ..... 345/63
2006/0001603 A1 * 1/2006 Kang et al. ..... 345/60

FOREIGN PATENT DOCUMENTS

EP 1 376 525 1/2004

OTHER PUBLICATIONS

Extended European Search Report Application No. 06010619.2 dated Oct. 22, 2008 (8 pages).

* cited by examiner

*Primary Examiner*—Amare Mengistu
*Assistant Examiner*—Insa Sadio
(74) *Attorney, Agent, or Firm*—Fish & Richardson P.C.

(57) ABSTRACT

The present invention discloses a method for driving a plasma display apparatus, wherein a scan signal, of which at least one of the voltage rising time or the voltage falling time is from 20 ns to 150 ns, is supplied to a scan electrode.

18 Claims, 15 Drawing Sheets

DRIVING METHOD OF PLASMA DISPLAY APPARATUS

This Nonprovisional application claims priority under 35 U.S.C. §119(a) on Patent Application No. 10-2005-63493 filed in Korea on Jul. 13, 2005 the entire contents of which are hereby incorporated by reference.

BACKGROUND OF THE INVENTION

1. Field of the Invention

This document relates to a driving method of plasma display apparatus.

2. Description of the Background Art

A plasma display apparatus displays an image through a plasma display panel which comprises cells formed between a front substrate and a rear substrate, the cells being filled with an inert gas consisting of a main discharge gas such as neon (Ne), helium (He), or a mixture thereof (Ne+He) and a small quantity of xenon. A discharge occurs when a driving signal is supplied to electrodes formed at the plasma display panel, whereupon the inert gas in the cells generate vacuum ultraviolet rays (Hereinafter, VUR) and the VUR excites phosphors formed within barrier ribs, to display an image.

A plasma display panel expresses gray scale of an image by combining subfields that constitute a frame. In other words, a frame comprises a plurality of subfields, and each subfield comprises a reset period for initializing the cell, an address period for selecting a cell, and a sustain period for an emission of the selected cell. A gray scale can be expressed as the total sustain period varies depending on combination of the subfields.

In the reset period of the subfield, a reset signal is supplied to a scan electrode of the plasma display panel and all cells of the plasma display panel are initialized. In the address period of a subfield, a scan signal is supplied to the scan electrode and a data signal is supplied to an address electrode, whereupon a cell is selected. In a sustain period, a sustain signal is supplied to at least one of the scan electrode or the sustain electrode, and a sustain discharge occurs at the selected cell.

SUMMARY OF THE INVENTION

A driving method of a plasma display apparatus according to an embodiment of the present invention, in which a scan electrode and an address electrode are formed, the method comprises supplying a falling voltage to the scan electrode during a first time so as to form a scan signal in an address period, supplying a scan voltage sustained during a second time after the first time to the scan electrode so as to form the scan signal in the address period and supplying a rising voltage to the scan electrode during a third time after the second time so as to form the scan signal in the address period, wherein at least one of the first time or the third time is from 20 ns to 150 ns.

A driving method of a plasma display apparatus according to another embodiment of the present invention, in which a scan electrode and an address electrode are formed, the method comprises supplying a falling voltage to the scan electrode during a first time so as to form a scan signal in an address period, supplying a scan voltage sustained during a second time after the first time to the scan electrode so as to form the scan signal in the address period, and supplying a rising voltage to the scan electrode during a third time after the second time so as to form the scan signal in the address period, wherein at least one of the first time or the third time is from 20 ns to 200 ns.

BRIEF DESCRIPTION OF THE DRAWINGS

The embodiments of the present invention will be described in detail with reference to the following drawings in which like numerals refer to like elements.

DETAILED DESCRIPTION OF PREFERRED EMBODIMENTS

Figure 1:
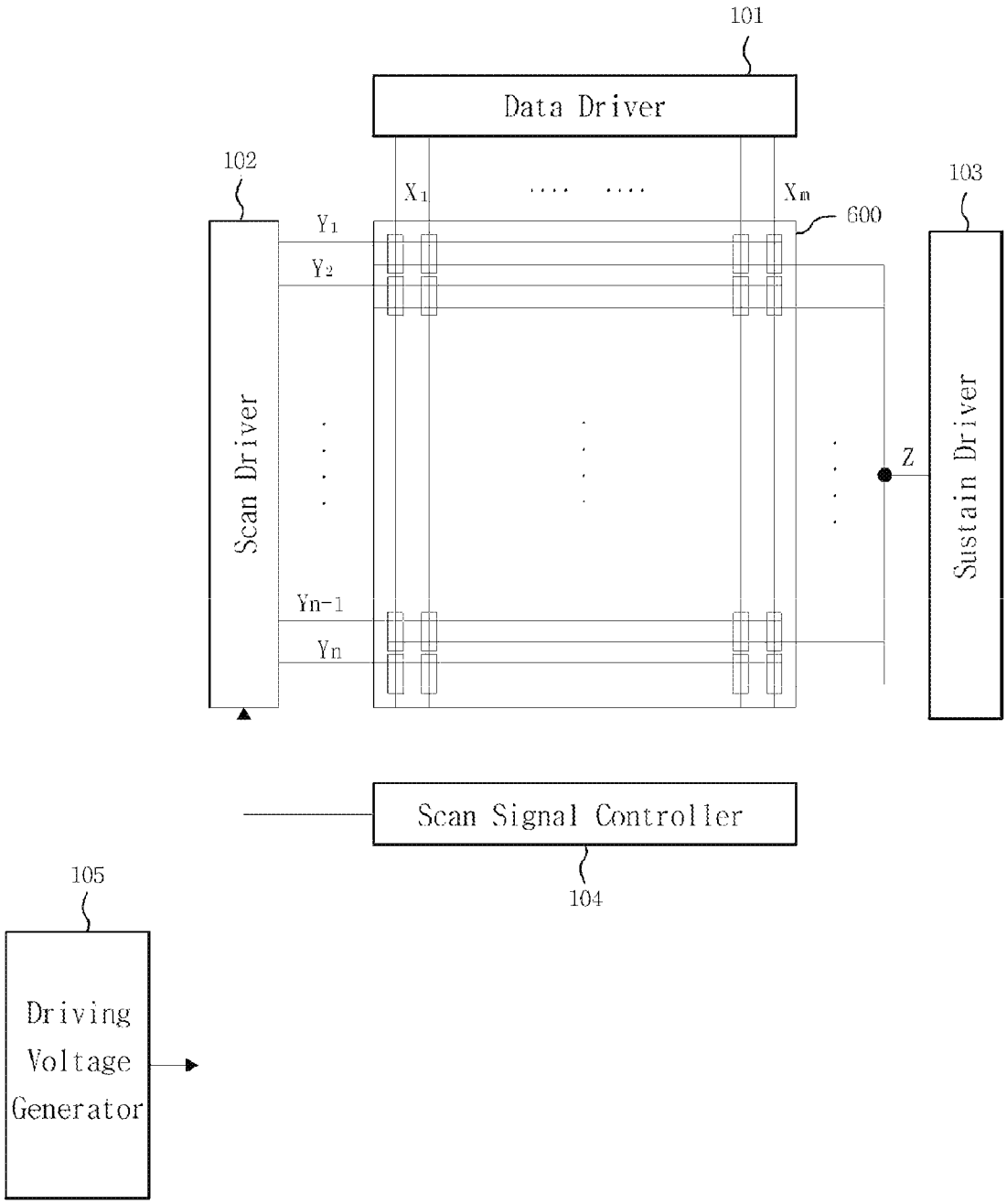
FIG. 1 illustrates a plasma display apparatus in accordance with a first embodiment of the present invention.

Preferred embodiments of the present invention will be described below in a more detailed manner with reference to the drawings.

A driving method of a plasma display apparatus according to an embodiment of the present invention, in which a scan electrode and an address electrode are formed, the method comprises supplying a falling voltage to the scan electrode during a first time so as to form a scan signal in an address period, supplying a scan voltage sustained during a second time after the first time to the scan electrode so as to form the scan signal in the address period and supplying a rising voltage to the scan electrode during a third time after the second time so as to form the scan signal in the address period, wherein at least one of the first time or the third time is from 20 ns to 150 ns.

The first time and the third time can be the same.

A time difference between a supply ending time point of a first scan signal supplied to the scan electrode and a supply starting time point of a second scan signal to another scan electrode adjacent to the scan electrode can be from 20 ns to 1000 ns.

A first scan electrode, a second scan electrode adjacent to the first electrode, and a third scan electrode adjacent to the second electrode can be formed in the plasma display apparatus, and wherein a time difference between a supply ending time point of a scan signal supplied to the first scan electrode and a supply starting time point of the scan signal supplied to the second scan electrode can be different from that between a supply ending time point of a scan signal supplied to the second scan electrode and a supply starting time point of the scan signal supplied to the third scan electrode.

The first time and the third time of a scan signal supplied to the scan electrode can be different from each other.

The scan electrode and another scan electrode can be formed in the plasma display apparatus, and wherein the second time of the scan voltage supplied to the scan electrode can be different from the second time of the scan voltage supplied to another scan electrode.

A data signal corresponding to a scan signal supplied to the scan electrode, can be supplied to the address electrode, and the second time of the scan voltage can be smaller than a sustain time of a data voltage of the data signal.

A voltage rising time of a data signal corresponding to the scan signal supplied to the address electrode can be different from a voltage falling time of the data signal.

The first time of the scan signal can be different from a voltage rising time of a data signal supplied to the address electrode corresponding to the scan signal.

The third time of the scan signal can be different from a voltage falling time of a data signal supplied to the address electrode corresponding to the scan signal.

The first time can be overlapped with a part of a time when a data voltage of a data signal supplied to the address electrode corresponding to the scan signal is sustained.

A part of the third time can be overlapped with a voltage falling time of a data signal supplied to the address electrode corresponding to the scan signal.

Each of a plurality of scan electrode group can comprise one or more scan electrodes, and the first time of a scan signal supplied to at least one scan electrode group of the plurality of scan electrode groups can be different from that of a scan signal supplied to the remaining scan electrode group of the plurality of scan electrode groups, or the third time of the scan signal supplied to at least one scan electrode group can be different from that of the scan signal supplied to the remaining scan electrode groups.

The number of scan electrodes comprised in each of the plurality of scan electrode groups can be the same.

The number of scan electrodes comprised in at least one scan electrode group of the plurality of scan electrode groups can be different from the number of scan electrodes comprised in the remaining scan electrode groups of the plurality of scan electrode groups.

The difference between the first times or the third times of scan signals supplied to two scan electrode groups of the plurality of scan electrode groups can be constant.

A sustain time of a scan voltage supplied to each of the plurality of scan electrodes can be the same.

A driving method of a plasma display apparatus according to another embodiment of the present invention, in which a scan electrode and an address electrode are formed, the method comprises supplying a falling voltage to the scan electrode during a first time so as to form a scan signal in an address period, supplying a scan voltage sustained during a second time after the first time to the scan electrode so as to form the scan signal in the address period, and supplying a rising voltage to the scan electrode during a third time after the second time so as to form the scan signal in the address period, wherein at least one of the first time or the third time is from 20 ns to 200 ns.

The scan signal can be supplied in an address period of at least one subfield of a plurality of subfields.

The plurality of subfields comprises the n number of subfields, a gray level weight of each subfield increases from the first subfield to the n subfield, the at least one subfield is the first subfield to the third subfield, and the n is the natural number of 4 or more.

In the following, embodiments of the present invention will be described in detail making reference to the accompanying drawings.

FIG. 1 illustrates a plasma display apparatus in accordance with a first embodiment of the present invention. As shown in FIG. 1, a plasma display apparatus in accordance with the first embodiment comprises a plurality of scan electrodes Y1 to Yn, a sustain electrode Z, and a plurality of address electrodes X1 to Xm.

A plasma display apparatus in accordance with the first embodiment comprises a plasma display panel 100 for displaying an image based on a driving signal supplied to at least one of the scan electrodes Y1 to Yn, the sustain electrode Z, or the address electrodes X1 to Xm.

A plasma display apparatus in accordance with the first embodiment example comprises a data driver 101 for supplying data to the plurality of address electrodes X1 to Xm, a scan driver 102 for driving the scan electrodes Y1 to Yn, a sustain driver 103 for driving the sustain electrode Z, a scan signal controller 104 for controlling the scan driver 102, and a driving voltage generator 105 for supplying necessary driving voltages to each of the drivers 101, 102, 103.

The scan driver 102 of the plasma display apparatus in accordance with the first embodiment of the present invention supplies a rising voltage to the plurality of scan electrodes Y1 to Yn during a first time so as to form a scan signal by control of the scan signal controller 104, supplies a sustain voltage sustained during a second time after the first time to the plurality of scan electrodes, and supplies a falling voltage during a third time to the plurality of scan electrodes, wherein at least one of the first time or the third time is from 20 ns to 150 ns.

In other words, the scan driver 102 supplies a reset signal to the plurality of scan electrodes Y1 to Yn in the reset period, supplies a scan signal for selection of a cell successively to the plurality of scan electrodes Y1 to Yn by control of the scan signal controller 104 in the address period, and then supplies a sustain signal to the plurality of scan electrodes Y1 to Yn. In the course of supplying the scan signal, the scan driver 102 can supply a falling voltage that falls from the ground level voltage GND to the scan voltage during 20 ns to 150 ns, or a rising voltage that rises from the scan voltage to the ground level voltage GND during 20 ns to 200 ns by control of the scan signal controller 104. Moreover, the scan driver 102 can supply a falling voltage that falls from the ground level voltage GND to the scan voltage during 20 ns to 150 ns, and a rising voltage that rises from the scan voltage to the grounf level voltage GND during 20 ns to 1500 ns by control of the scan signal controller 104.

The sustain driver 103 supplies a bias voltage to the sustain electrode Z, and supplies a sustain signal to the sustain electrode Z in the sustain period.

The driving voltage generator 105 supplies voltages for forming the reset signal, the data signal, the sustain signal, and the bias voltage.

Figure 2:
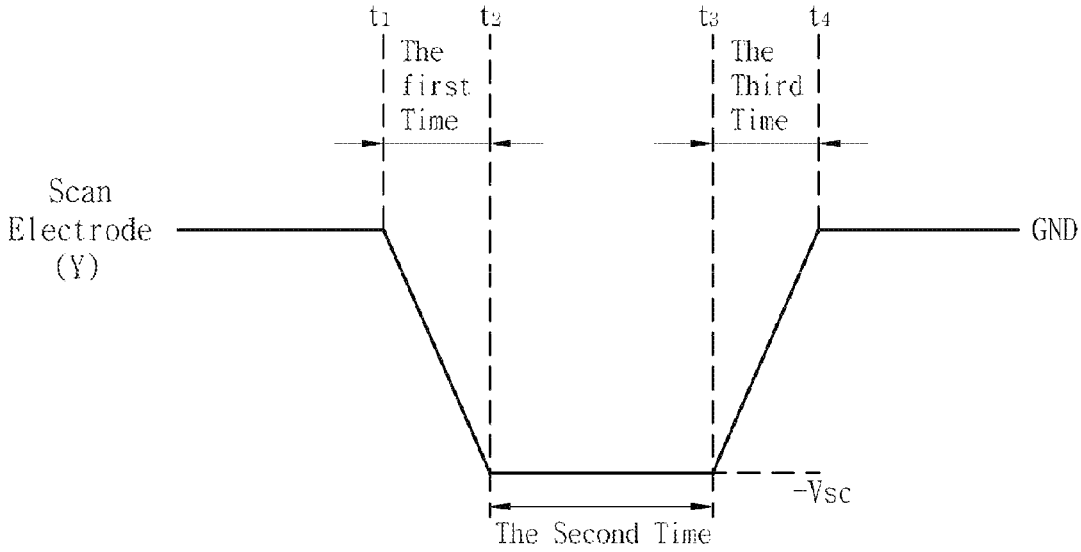
FIG. 2 illustrates a wave form generated by a driving method of plasma display apparatus in accordance with the first embodiment of the present invention.

FIG. 2 illustrates a wave form generated by a driving method of plasma display apparatus in accordance with the first embodiment of the present invention. As shown in FIG. 2, one or more of the first time or the third time is from 20 ns to 150 ns. The scan driver 102 in FIG. 1 supplies a falling voltage that starts to fall from the ground level voltage GND at time point t1 and reaches the scan voltage (−Vsc) at time point t2, as well as a scan voltage (−Vsc) from time point t2 to t3 to the scan electrode Y by control of the scan signal controller 104. Then, the scan driver 102 supplies a rising voltage that starts to rise from the scan voltage (−Vsc) at time point t3 and reaches the ground level voltage GND at time point t4 to the scan electrode Y by control of the scan signal controller 104. The time difference (the first time) between time point t1 and time point t2 is from 20 ns to 150 ns, and the time difference (the third time) between time point t3 and time point t4 is from 20 ns to 150 ns.

The first time is the time period from a time point when the voltage of the scan signal starts to fall to a time point when the voltage of the scan signal reaches 90% or more of the scan voltage (−Vsc), and the third time is the time period from a time point when the voltage of the scan signal starts to rise to a time point when the voltage of the scan signal reaches 10% or below of the GND. Hereinafter, the first time is called a voltage falling time, and the third time is called a voltage rising time.

When the scan driver 102 supplies a scan signal, of which at least one of the voltage falling time or the voltage rising time is from 20 ns to 150 ns, to the scan electrode Y in the address period, the magnitude of noise generated during the supply of the scan signal is decreased.

Figure 3:
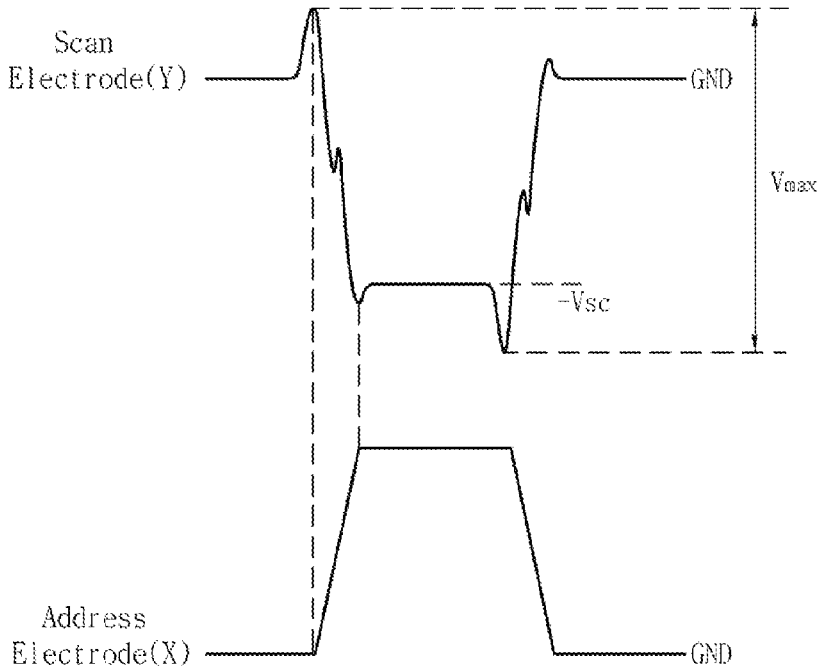
FIG. 3 is a drawing for explanation of a noise generated by a scan signal supplied to a scan electrode in an address period.

Namely, when at least one of the voltage rising time or the voltage falling time is less than 20 ns, the magnitude of noise generated increases rapidly, as shown in FIG. 3. At the time point when the data signal supplied synchronously with the scan signal to the address electrode X, rises, a noise having a higher voltage than that of the ground level voltage GND is generated at the scan electrode Y. At the time point when the data signal falls, a noise having a voltage lower than that of the scan voltage (−Vsc) is generated at the scan electrode Y. The noise is generated by changes in voltage difference between the scan electrode Y and the address electrode X, that are caused by supplies of the scan signal and the data signal, and, when at least one of the voltage rising time or the voltage falling time of the scan signal is less than 20 ns, the volume of noise to be generated increases rapidly as the voltage difference between the scan electrode Y and the address electrode X grows.

When the magnitude of a noise (Vmax), which is the voltage difference between the highest level voltage and the lowest level voltage of a noise, increases excessively, an unstable address discharge occurs, which not only reduces the driving efficiency of a plasma display apparatus, but can also damage the integrated circuit (Hereinafter, IC) of the scan driver that supplies a scan signal.

Figure 4:
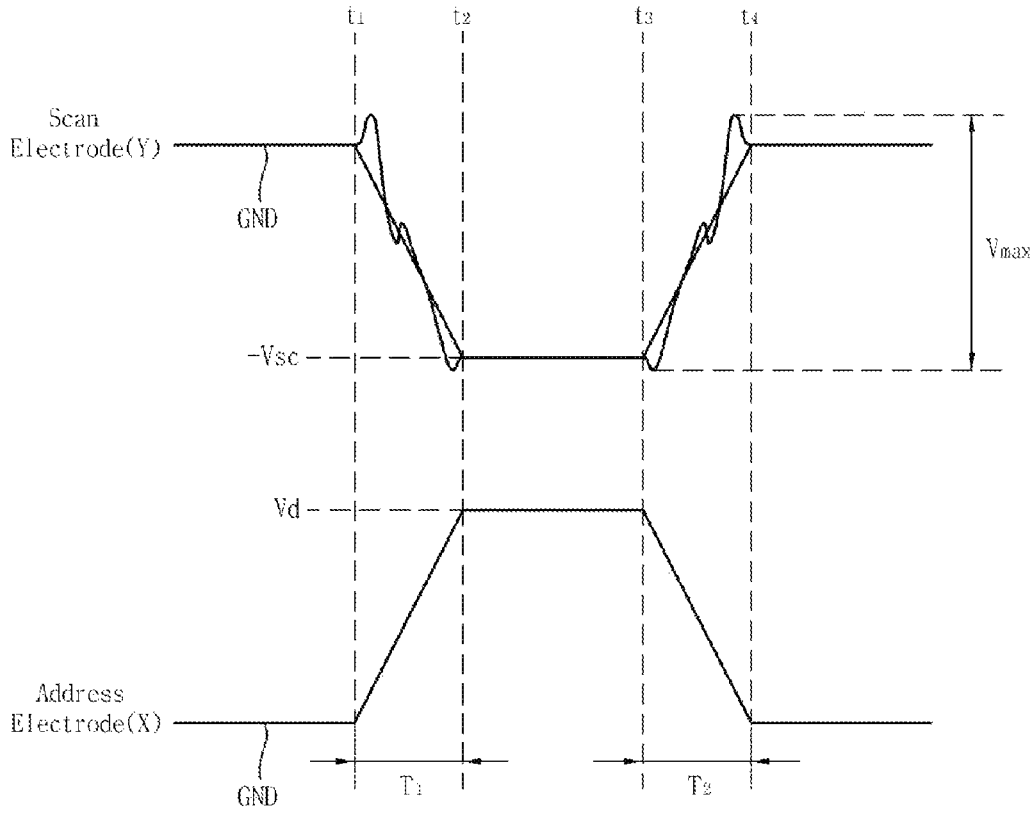
FIG. 4 illustrates a noise generated by a scan signal formed by the driving method of plasma display apparatus in accordance with the first embodiment of the present invention.

In contrast thereto, when the scan driver 102 supplies a scan signal, of which at least one of the voltage rising time or the voltage falling time is equal to or more than 20 ns by control of the scan signal controller 104 in accordance with an embodiment example of the present invention, the noise is reduced as in FIG. 4 in comparison to that in FIG. 3.

That is, if the voltage falling time (t2-t1) and the voltage rising time (t4-t3) of the scan signal is equal to or more than 20 ns, the noise generated at the scan electrode Y decreases, when the data signal rises, and the noise generated at the scan electrode Y decreases, when the data signal falls. In this manner, magnitude of the noise (Vmax) decreases and the address discharge is stabilized, so that driving efficiency of the plasma display apparatus increases and a damage of the scan drive IC is prevented.

However, when at least one of the voltage falling time or the voltage rising time of the scan signal more than 150 ns, a wall discharge sufficient for an address discharge may not be formed so that the address period can be prolonged, and the setting of a subsequent sustain period can be affected.

Furthermore, when at least one of the voltage falling time or the voltage rising time of the scan signal is 150 ns or less, a more stable address discharge as well as a margin on the sustain period can be secured, although the magnitude of noise slightly increases here in comparison to that generated in the case when at least one of the voltage falling time or the voltage rising time of the scan signal is more than 150 ns.

It is also possible that the scan driver 102 supplies a scan signal, of which at least one of the voltage falling time or the voltage rising time is from 20 ns to 200 ns, to the scan electrode Y in the address period. When at least one of the voltage falling time or the voltage rising time of the scan signal is from 20 ns to 200 ns, the magnitude of noise generated here is smaller than that generated when at least one of the voltage falling signal or the voltage rising time is from 20 ns to 150 ns.

The scan driver 102 can supply a scan signal, of which at least one of the voltage falling time or the voltage rising time is from 20 ns to 200 ns, in at least one subfield address period among the plurality of subfields. For example, when the plurality of subfields comprises the n number of subfields, a gray level weight of each subfield increases from the first to the n subfield (the n is the natural number of 4 or more), the scan driver 102 can supply in the address period a scan signal, of which at least one of the voltage falling time or the voltage rising time is from 20 ns to 200 ns, to the first subfield and the third subfield, in their respective address period.

In a low gradation image expressed by a subfield having a low gray level weight, the image quality deteriorates when a noise of great magnitude is generated and an unstable address discharge occurs. Thus, the scan driver 102 supplies in the address period a scan signal, of which at least one of the voltage falling time or the voltage rising time is from 20 ns to 200 ns, to the first subfield and the third subfield, in their respective address period.

The voltage rising time and the voltage falling time of the data signal supplied to the address electrode X, corresponding to the scan signal supplied to the scan electrode Y, are also from 20 ns to 150 ns as shown in FIG. 4. Although the voltage rising time and the voltage falling time of the data signal as depicted in FIG. 4 are the same, they can also be different from each other. The voltage rising time of the data signal is the time period from a time point when a voltage of the data signal starts to rise (t1) to a time point when the voltage of the data signal reaches 90% or more of the maximum voltage (t2) of the data signal, and the voltage falling time is a time period from a time point when the voltage of the data signal starts to fall (t3) to a time point when the voltage of the data signal reaches 10% or below of the maximum voltage (t4).

In FIG. 4, the sustain time (t3-t2) of the scan voltage (−Vsc) supplied to the scan electrode Y is the same as that (t3-t2) of the data voltage supplied to the address electrode X. When the voltage rising time (t3-t2), the sustain time (t3-t2), and the voltage falling time (t3-t2) of the scan signal are the same as their corresponding times of the data signal, a stable address discharge occurs by interactions between the scan signal and the data signal.

Figure 5:
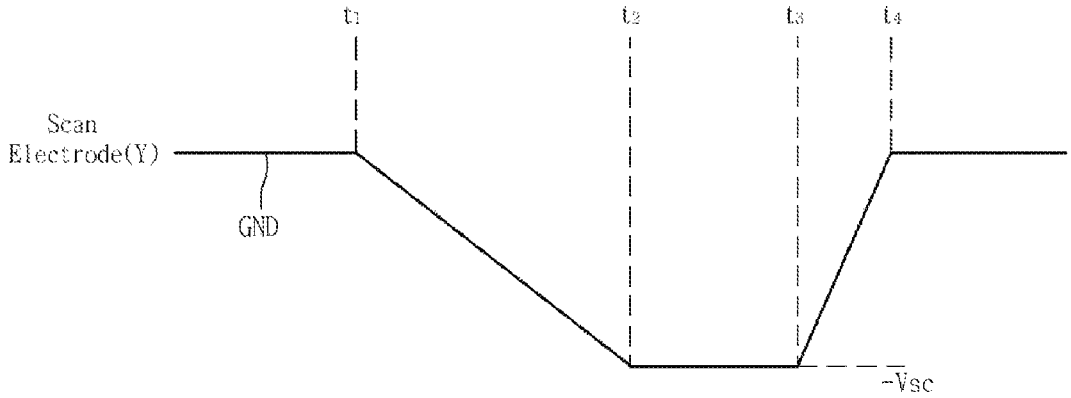
FIG. 5 illustrates a wave form generated by a driving method of plasma display apparatus in accordance with a second embodiment of the present invention.

FIG. 5 illustrates a wave form generated by a driving method of plasma display apparatus in accordance with a second embodiment of the present invention. In the driving method of a plasma display apparatus in accordance with the second embodiment of the present invention, the scan driver 102 as in FIG. 1 supplies a scan signal, of which the voltage falling time (t2-t1) is longer than the voltage rising time (t4-t3) and the voltage falling time is from 20 ns to 150 ns to the scan electrode Y by control of the scan signal controller 104 in the address period.

Figure 6:
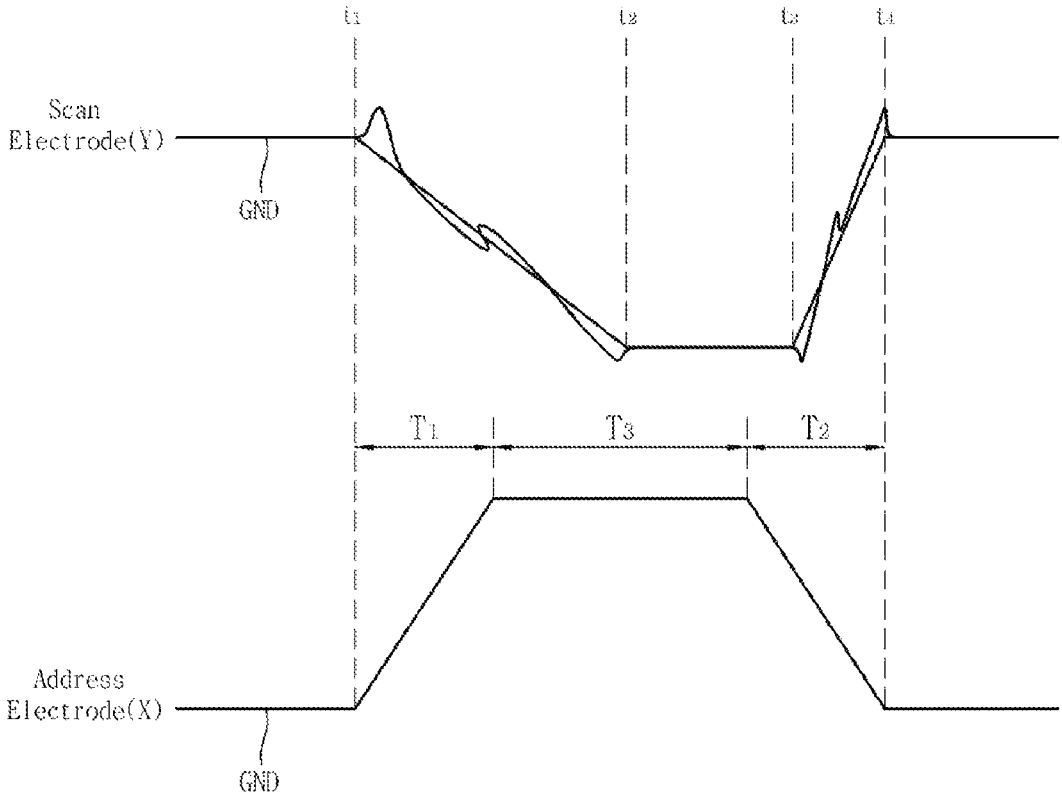
FIG. 6 illustrates a noise generated by a scan signal formed by the driving method of plasma display apparatus in accordance with the second embodiment of the present invention.

FIG. 6 illustrates a noise generated by a scan signal formed by a driving method of plasma display apparatus in accordance with the second embodiment of the present invention. As shown in FIG. 6, the noise generated by a scan signal formed by a driving method of plasma display apparatus in accordance with the second embodiment of the present invention is reduced in comparison to that shown in FIG. 3. In particular, the noise decreases drastically at the time point when the scan signal starts to fall (t1).

Further, the voltage rising time of the scan signal (t4-t3) and the voltage rising time of the data signal (T2) are different from each other, and the voltage falling time of the scan signal (t2-t1) and the voltage rising time of the data signal (T1) are different from each other. Thus, the voltage falling time of the data signal (T2) overlaps with a part of the sustain time of the scan voltage (t3-t2), and the voltage falling time of the scan signal (t2-t1) overlaps in part with the sustain time of the data signal (T3). Since the voltage difference between the scan electrode Y to which the scan signal is supplied and the address electrode X to which the data signal is supplied is reduced as above, the noise generation is reduced as well.

Moreover, the sustain time of the data voltage (T3) is longer than the sustain time of the scan voltage (t2-t1). Thus, a stable address discharge occurs by interactions between the scan signal and the data signal, even when any one of the voltage falling time of the scan signal (t2-t1) or the voltage rising time (t4-t3) of the scan signal is modified.

Figure 7:
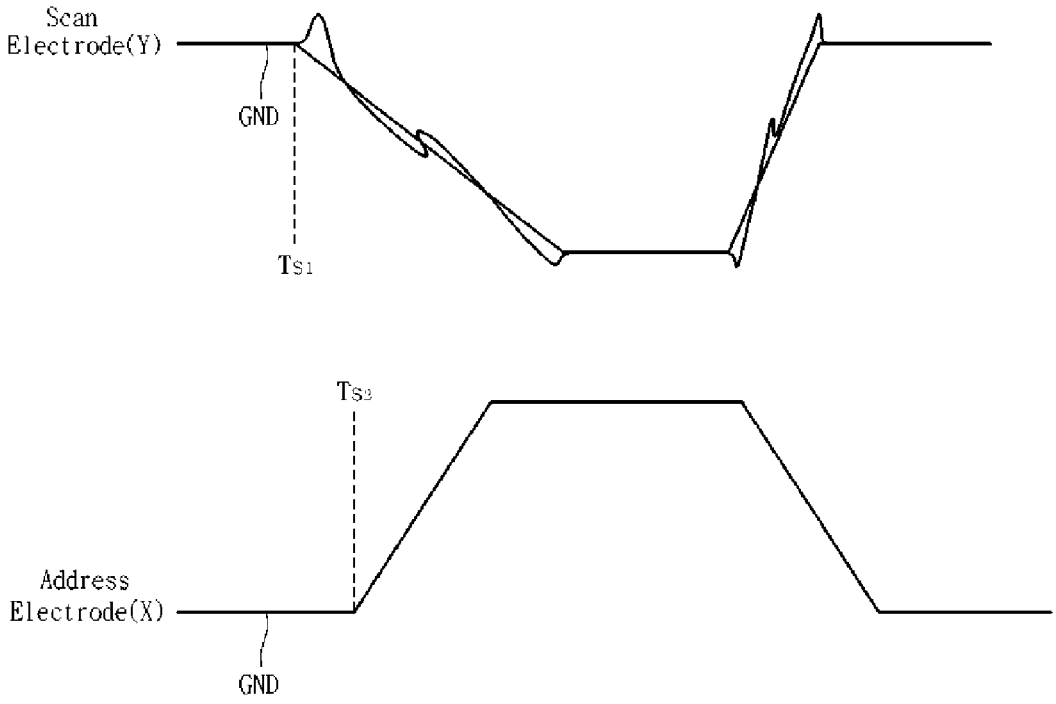
FIG. 7 illustrates another example of a scan signal and a data signal supplied by the driving method of plasma display apparatus in accordance with the second embodiment of the present invention.

As shown in FIG. 6, a supplying time point of the scan signal is the same as the supplying time point of the sustain signal. However, as shown in FIG. 7, the supplying time point of the scan signal may be different from the supplying time point of the sustain signal. For example, the supplying time point $T_{s1}$ of the scan signal is earlier than the supplying time point $T_{s2}$ of the sustain signal.

Figure 8:
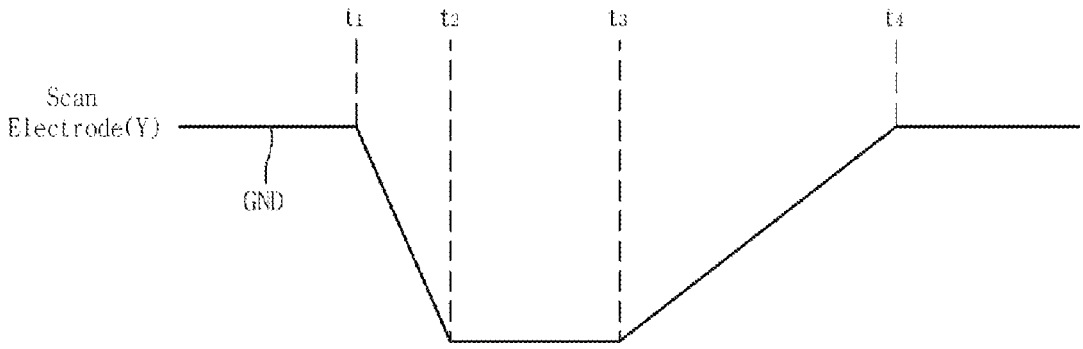
FIG. 8 illustrates a wave form generated by a driving method of plasma display apparatus in accordance with a third embodiment ex of the present invention.

FIG. 8 illustrates a wave form generated by a driving method of plasma display apparatus in accordance with a third embodiment of the present invention. In the driving method of a plasma display apparatus in accordance with the third embodiment of the present invention, the scan driver 102 as in FIG. 1 supplies a scan signal, of which the voltage rising time (t4-t3) is longer than the voltage falling time (t2-t1) and the voltage rising time (t4-t3) is from 20 ns to 150 ns, to the scan electrode Y by control of the scan signal controller 104 in the address period.

Figure 9:
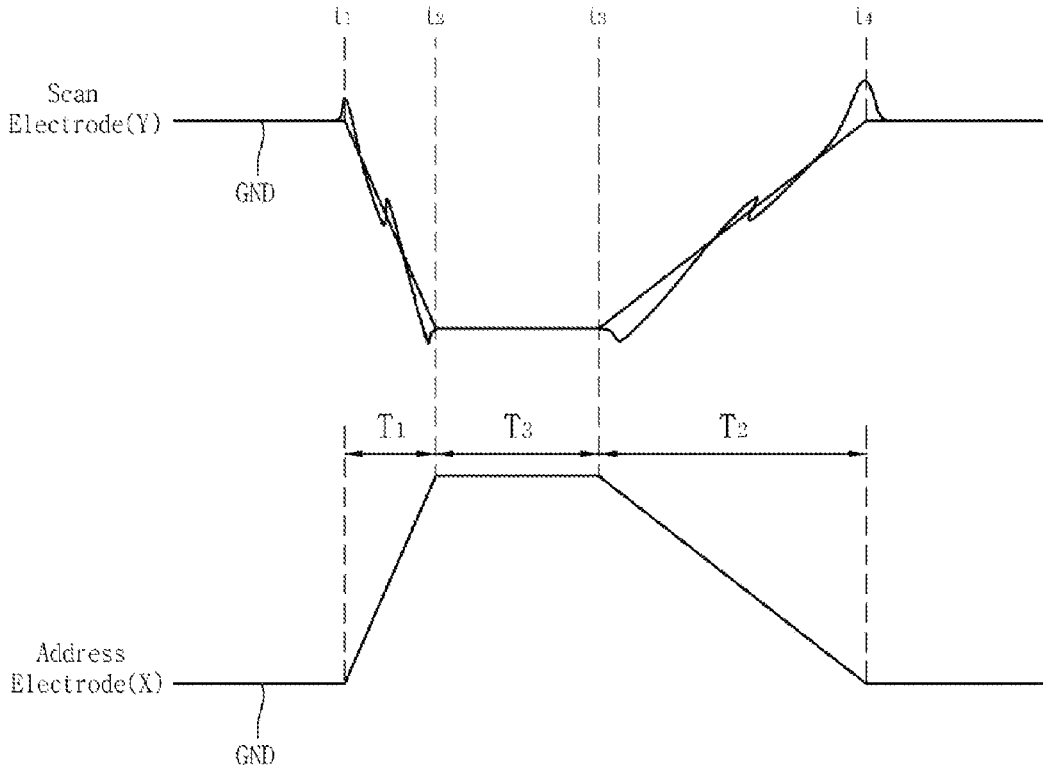
FIG. 9 illustrates a noise generated by a scan signal formed by the driving method of plasma display apparatus in accordance with the third embodiment of the present invention.

FIG. 9 illustrates a noise generated by a scan signal formed by a driving method of plasma display apparatus in accordance with the third embodiment of the present invention. As shown in FIG. 9, the noise generated by a scan signal formed by a driving method of plasma display apparatus in accordance with the third embodiment of the present invention is reduced in comparison to that shown in FIG. 3. In particular, the noise decreases drastically at the time point when the scan signal starts to rise (t3).

Further, the data driver 101 in FIG. 1 supplies a data signal having a voltage falling time (T2) and a voltage rising time (T1) same as the voltage rising time (t4-t3) and the voltage falling time (t2-t1) of the scan signal to the address electrode X.

Figure 10:
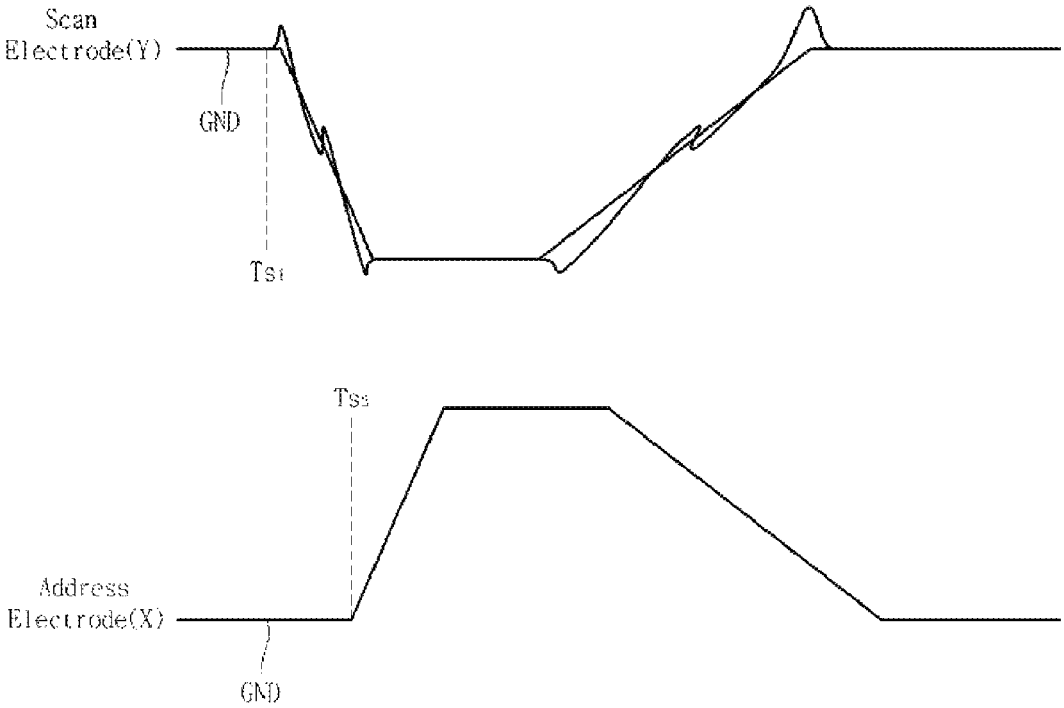
FIG. 10 illustrates another example of a scan signal and a data signal supplied by the driving method of plasma display apparatus in accordance with the third embodiment of the present invention.

As shown in FIG. 9, a supplying time point of the scan signal is the same as the supplying time point of the sustain signal. However, as shown in FIG. 10, the supplying time point of the scan signal may be different from the supplying time point of the sustain signal. For example, the supplying time point $T_{s1}$ of the scan signal is earlier than the supplying time point $T_{s2}$ of the sustain signal.

Figure 11:
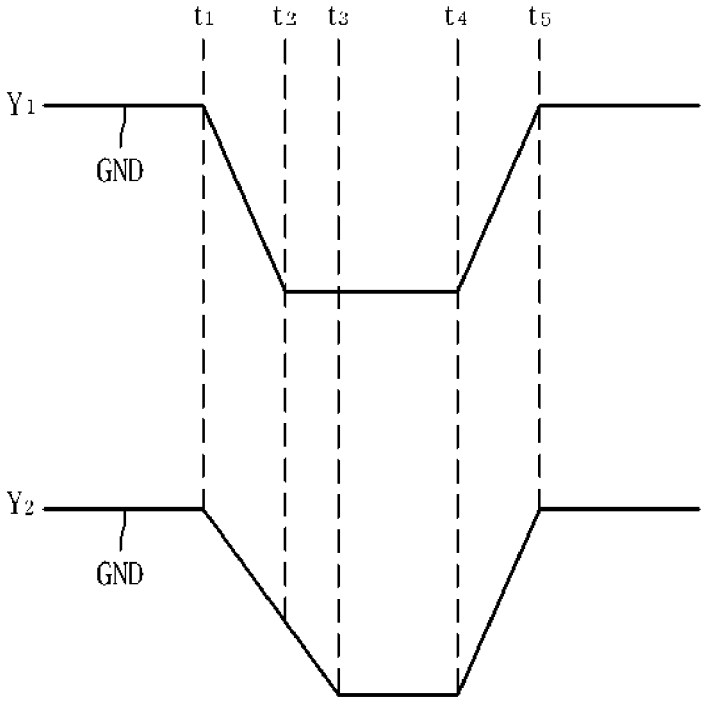
FIG. 11 illustrates a wave form generated by a driving method of plasma display apparatus in accordance with a fourth embodiment of the present invention.

FIG. 11 illustrates a wave form generated by a driving method of plasma display apparatus in accordance with a fourth embodiment of the present invention. The scan driver 102 in FIG. 1 supplies scan signals with different voltage falling times to two scan electrodes Y1, Y2. For example, as shown in FIG. 9, the scan driver 102 supplies a scan signal with a voltage falling time (t2-t1) to a scan electrode Y1, and a scan signal having a voltage falling time (t3-t1) to another scan electrode Y2. Here, the voltage falling times (t2-t1), (t3-t1) of the scan electrode to be supplied to one scan electrode Y1, and to another scan electrode Y2, are from 20 ns to 150 ns. Moreover, the scan driver 102 can also supply a scan signal having a voltage rising time (t5-t4) to two scan electrodes Y1, Y2.

Figure 12:
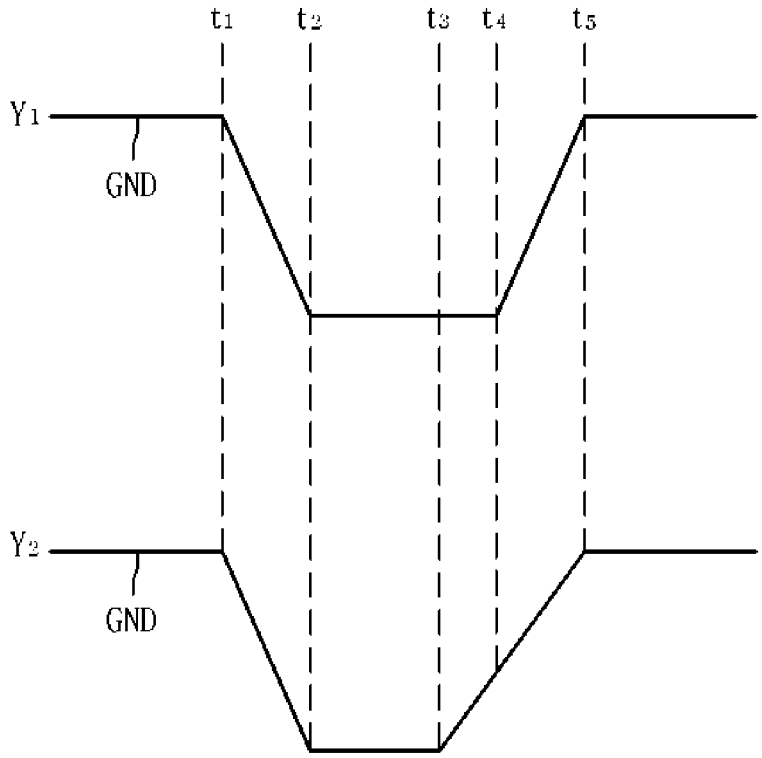
FIG. 12 illustrates a wave form generated by a driving method of plasma display apparatus in accordance with a fifth embodiment of the present invention.

FIG. 12 illustrates a wave form generated by a driving method of plasma display apparatus in accordance with a fifth embodiment of the present invention. The scan driver 102 in FIG. 1 supplies scan signals with different voltage rising times to two scan electrodes Y1, Y2. For example, as shown in FIG. 12, the scan driver 102 supplies a scan signal with a voltage rising time (t5-t4) to a scan electrode Y1, and a scan signal having a voltage rising time (t5-t3) to another scan electrode Y2. Here, the voltage rising times (t5-t4), (t5-t3) of the scan electrode to be supplied to one scan electrode Y1, and to another scan electrode Y2, are from 20 ns to 150 ns. Moreover, the scan driver 102 can also supply a scan signal having a voltage falling time (t2-t1) to two scan electrodes Y1, Y2.

Figure 13:
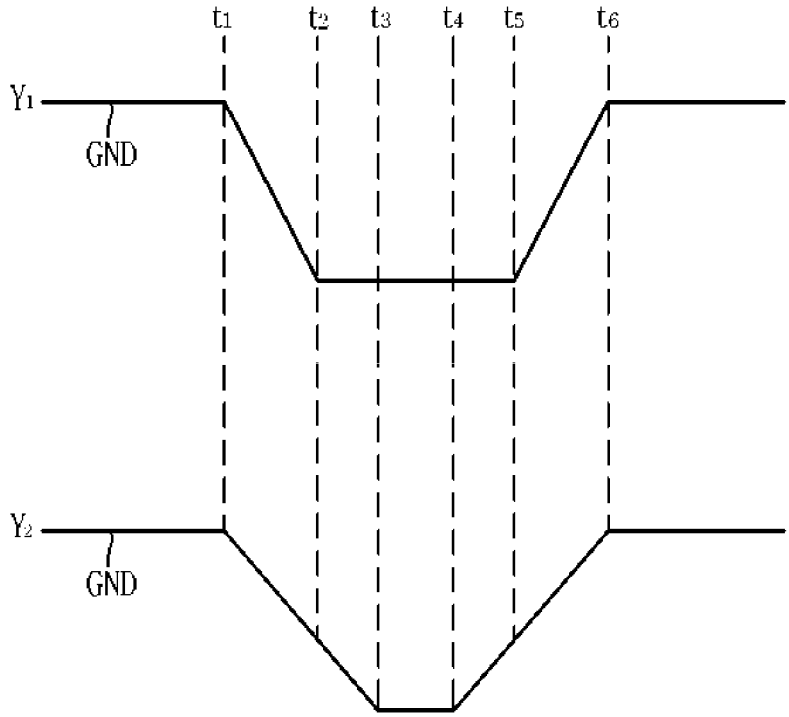
FIG. 13 illustrates a wave form generated by a driving method of plasma display apparatus in accordance with a sixth embodiment of the present invention.

FIG. 13 illustrates a wave form generated by a driving method of plasma display apparatus in accordance with a sixth embodiment of the present invention. The scan driver 102 in FIG. 1 supplies scan signals with different voltage rising time and voltage falling time to two scan electrodes Y1, Y2. For example, as shown in FIG. 10, the scan driver 102 supplies a scan signal having a voltage falling time (t2-t1) to a scan electrode Y1, and a scan signal having a voltage falling time (t3-t1) to another scan electrode Y2. Further, the scan driver 102 supplies a scan signal having a voltage rising time (t6-t5) to a scan electrode Y1, and a scan signal having a voltage rising time (t6-t4) to another scan electrode Y2. Here, the voltage falling times (t2-t1), (t3-t1) and the voltage rising time (t6-t5), (t6-t4) of the scan electrode to be supplied to one scan electrode Y1, and to another scan electrode Y2, are from 20 ns to 150 ns.

At least one of the voltage rising time or the voltage falling time of the scan signal supplied to a scan electrode and to another scan electrode is set differently in the driving method of a plasma display apparatus in accordance with the fourth to sixth embodiments of the present invention, so that the scan signal matches with the voltage rising time or with the voltage falling time of the data signal supplied to the discharge cells formed on each scan electrode.

For example, when the voltage rising time of the data signal supplied to the discharge cell formed on one scan electrode Y1 among the plurality of scan electrodes is longer than the voltage falling time thereof, and the voltage falling time of the data signal supplied to the discharge cell formed on another scan electrode Y2 is longer than the voltage rising time thereof, the scan driver 102 in FIG. 1 supplies a scan signal having a longer voltage falling time than the voltage rising time to one scan electrode Y1, and supplies a scan signal having a longer voltage rising time than the voltage falling time to another scan electrode Y2 by control of the scan signal controller 104, in order to let the sustain time of the scan voltage approximate to the sustain time of the data voltage.

Figure 14:
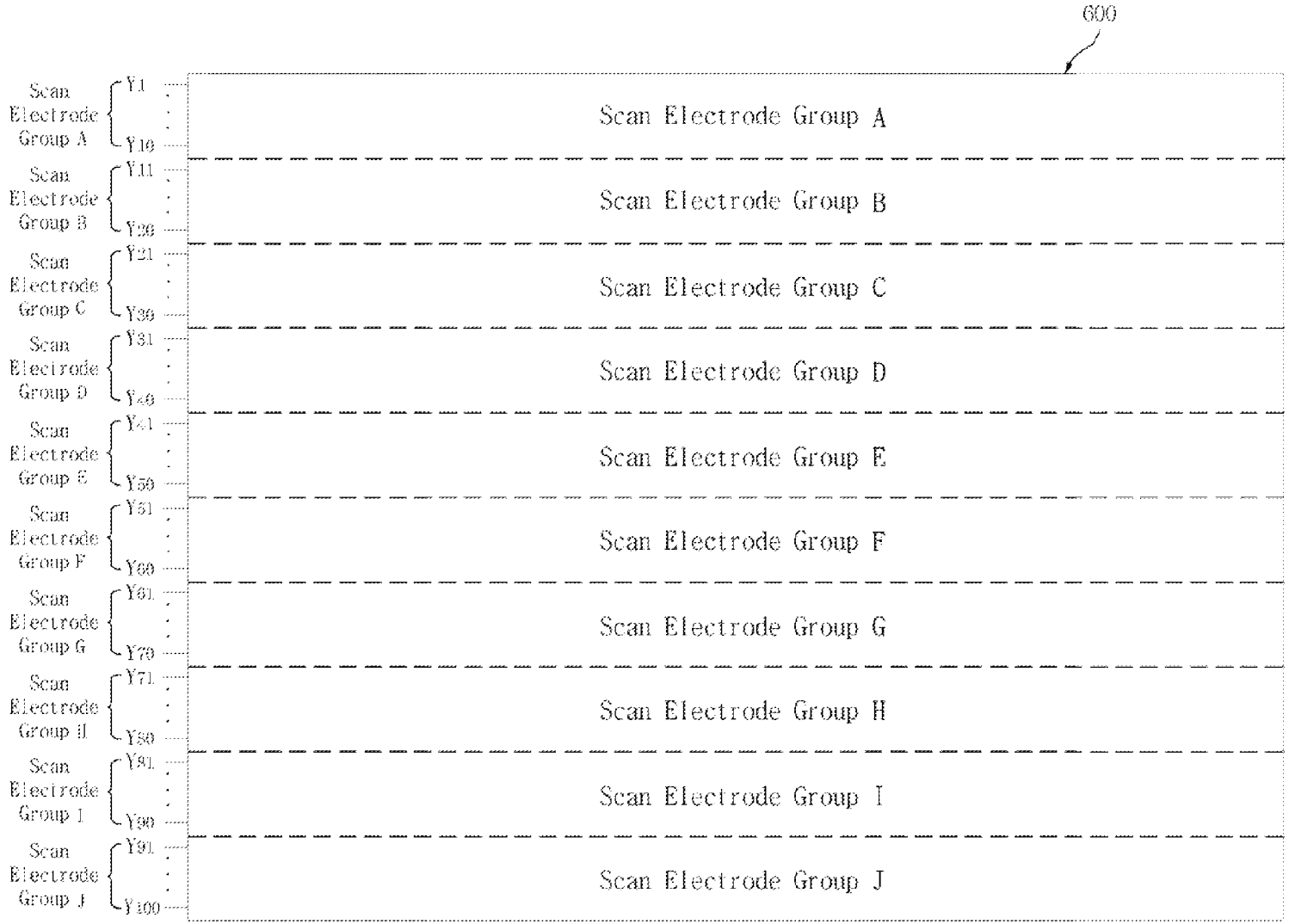
FIGS. 14 and 15 are drawings for explanation of a driving method of plasma display apparatus in accordance with a seventh embodiment of the present invention.
Figure 15:
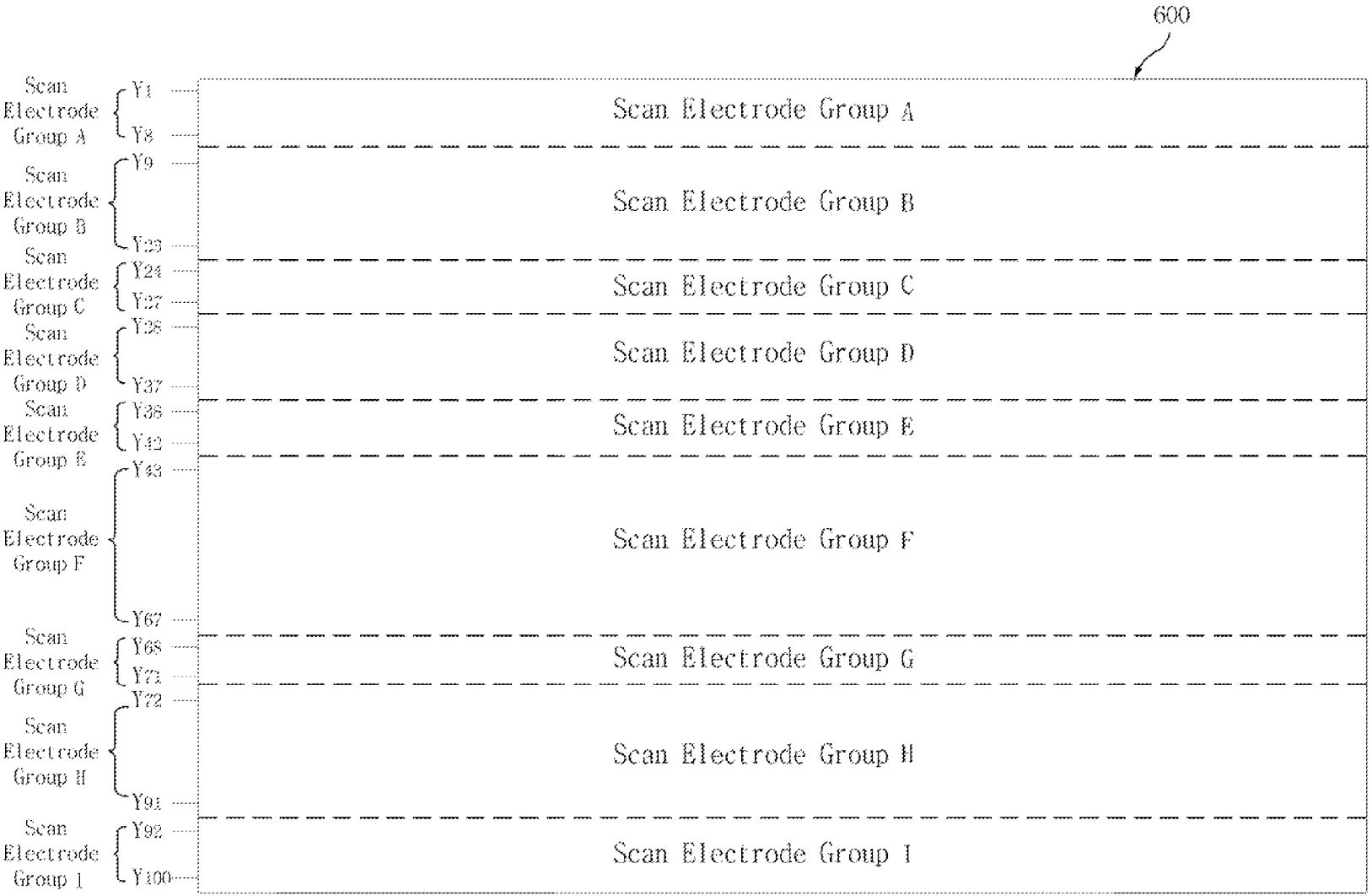

FIGS. 14 and 15 are drawings for explanation of a driving method of plasma display apparatus in accordance with a seventh embodiment of the present invention. As shown in FIG. 14, the scan electrodes Y1~Yn formed on the plasma display panel 100 are divided into 10 scan electrode groups (scan electrode group A to scan electrode group J), each scan electrode group comprising 10 scan electrodes. The number of scan electrodes in a scan electrode group can be the same as in FIG. 14, or the number of scan electrodes in a scan electrode group can differ from each other as in FIG. 13. Although each of the scan electrode group in FIG. 14 or FIG. 15 comprises a plurality of scan electrodes, each scan electrode group can also comprise at least one scan electrode among the whole scan electrodes.

Figure 16:
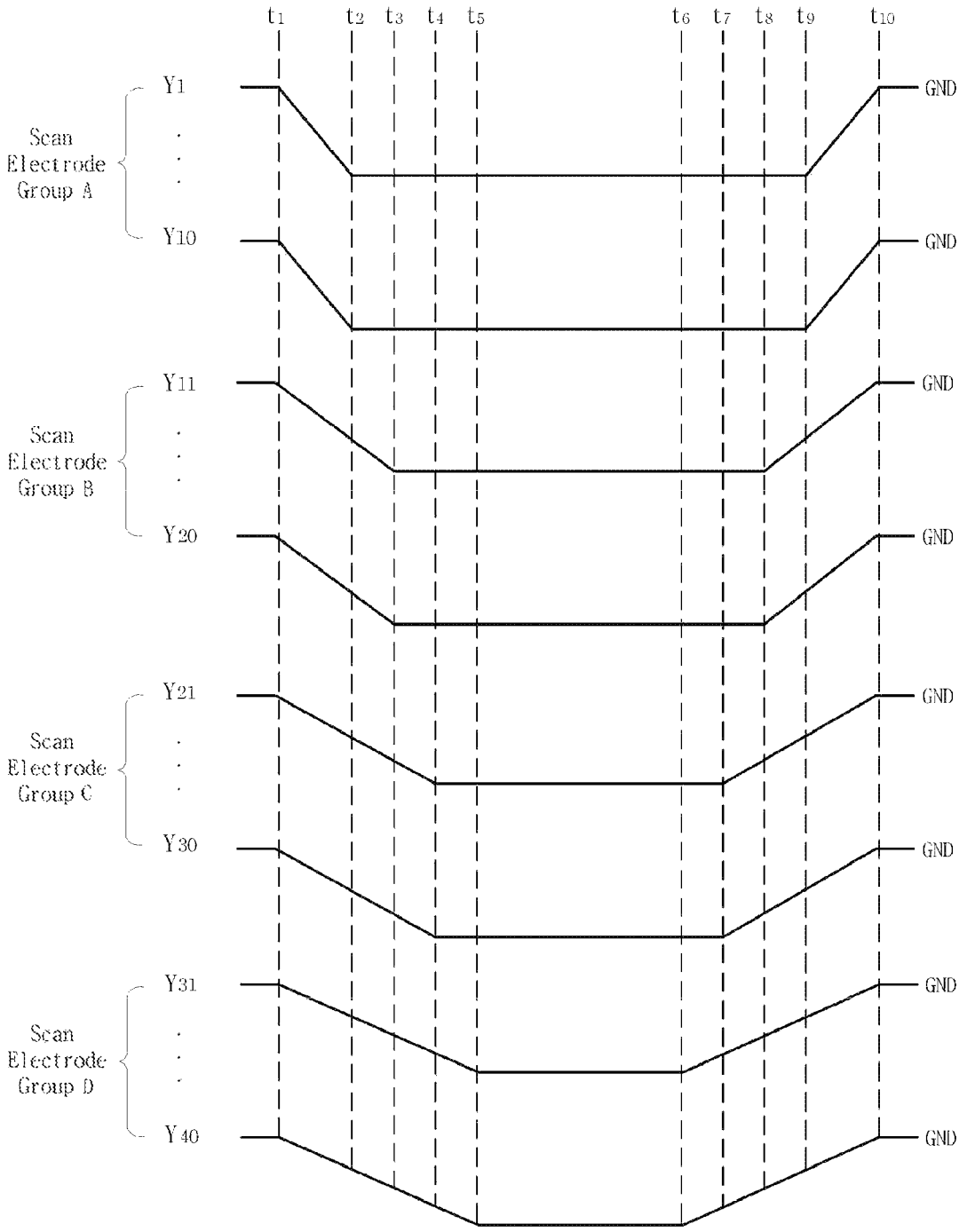
FIG. 16 illustrates a wave form generated by the driving method of plasma display apparatus in accordance with a seventh embodiment of the present invention.

FIG. 16 illustrates a wave form generated by a driving method of plasma display apparatus in accordance with a seventh embodiment of the present invention. The scan driver 102 in FIG. 1 supplies a scan signal, of which at least one of the voltage rising time and the voltage falling time is from 20 ns to 150 ns by control of the scan signal controller 104. The scan driver 102 in FIG. 1 supplies a scan signal having a voltage falling time different from the voltage falling time of a scan signal supplied to at least one scan electrode group among a plurality of scan electrode groups (scan electrode group A to scan electrode group D) to a remaining scan electrode group, or supplies a scan signal having a voltage rising time different from the voltage rising time of a scan signal supplied to at least one scan electrode group among the plurality of scan electrode groups (scan electrode group A to scan electrode group D) to a remaining scan electrode group; or supplies a scan signal having a voltage falling time as well as a voltage rising time different from the voltage falling time and the voltage rising time, respectively of a scan signal supplied to at least one scan electrode group among the plurality of scan electrode groups (scan electrode group A to scan electrode group D) to a remaining scan electrode group.

For example, the voltage falling time and the voltage rising time of the scan signal supplied to each of the plurality of scan electrode group are different from each other, as shown in FIG. 16. That is, the voltage falling times and the voltage rising times of the scan electrode group A to scan electrode group D are, t2-t1 and t10-t9, t3-t1 and t10-t8, t4-t1 and t10-t7, and t5-t1 and t10-t6.

Furthermore, it is also possible that only the voltage falling times of the scan signal supplied to each of the plurality of scan electrode group are different from each other, and/or only the voltage rising time of the scan signal supplied to each of the plurality of scan electrode group are different from each other.

Moreover, the difference in the voltage falling times or the voltage rising times of scan signals supplied to each scan electrode group can be constant. If t3-t2, t4-t3, and t5-t4 are the same, and t7-t6, t8-t7, and t9-t8 are the same, the difference in the voltage falling times or the difference in the voltage rising times of the scan signals supplied to each scan electrode group can be constant, as shown in FIG. 16.

It is also possible that the scan driver 102 supplies a scan signal, of which at least one of the voltage falling time or the voltage rising time is from 20 ns to 200 ns, to the scan electrode Y in the address period. The magnitude of noise generated when at least one of the voltage falling signal or the voltage rising time of the scan signal is from 20 ns to 200 ns, is smaller than the magnitude of noise generated when at least one of the voltage falling signal or the voltage rising time of the scan signal is from 20 ns to 150 ns.

Figure 17:
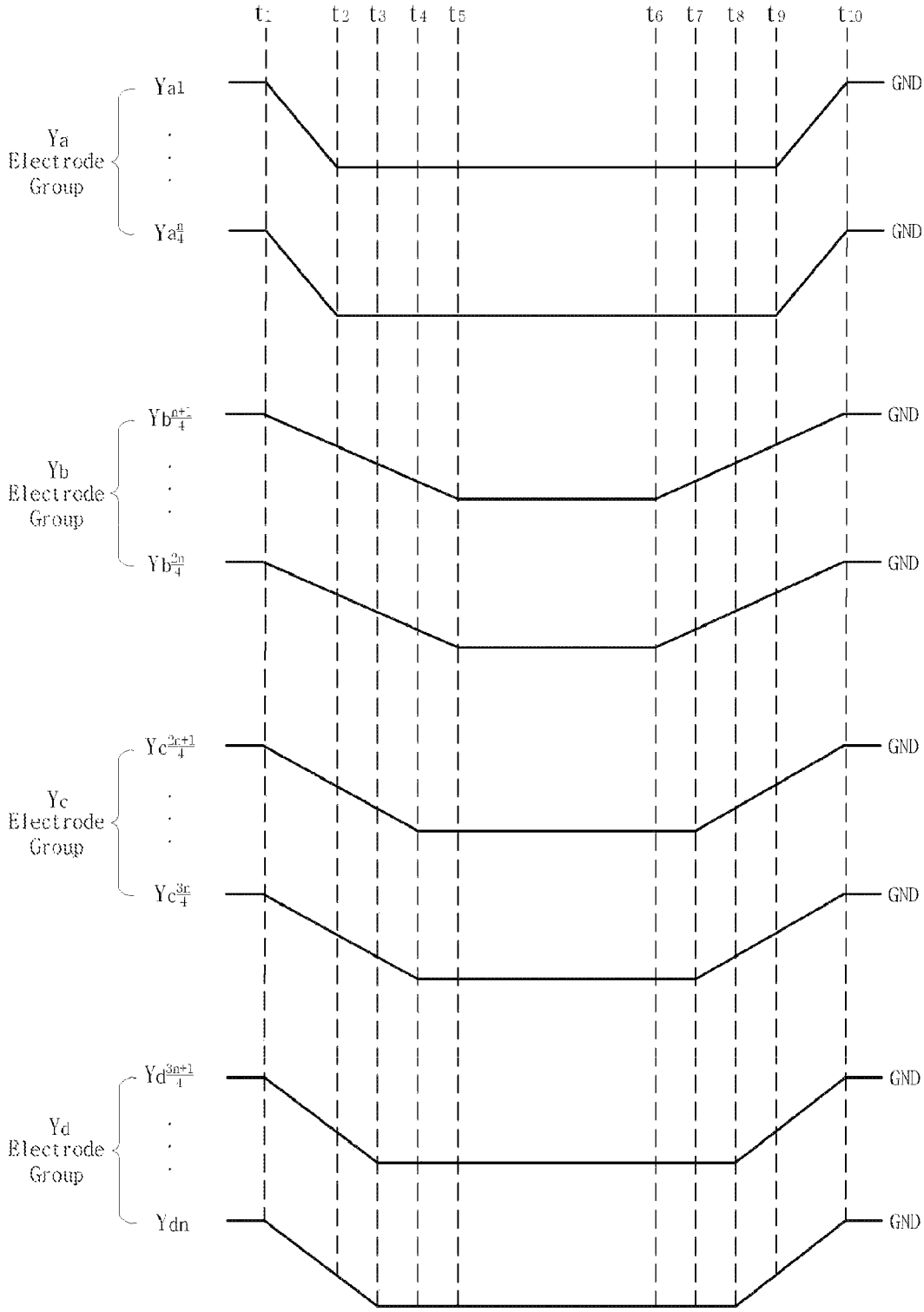
FIG. 17 illustrates a wave form generated by a driving method of plasma display apparatus in accordance with an eighth embodiment of the present invention.

FIG. 17 illustrates a wave form generated by a driving method of plasma display apparatus in accordance with an eighth embodiment of the present invention. Although the voltage falling time or the voltage rising time of scan signals have risen according to the sequence of the scan electrode groups in the seventh embodiment of the present invention as shown in FIG. 16, the voltage falling time or the voltage rising time varies independently from the sequence of the scan electrode groups in the eighth embodiment of the present invention, as shown in FIG. 17. Here, at least one of the voltage falling time or the voltage rising time of scan signals supplied to each scan electrode group is from 20 ns to 150 ns.

Figure 18:
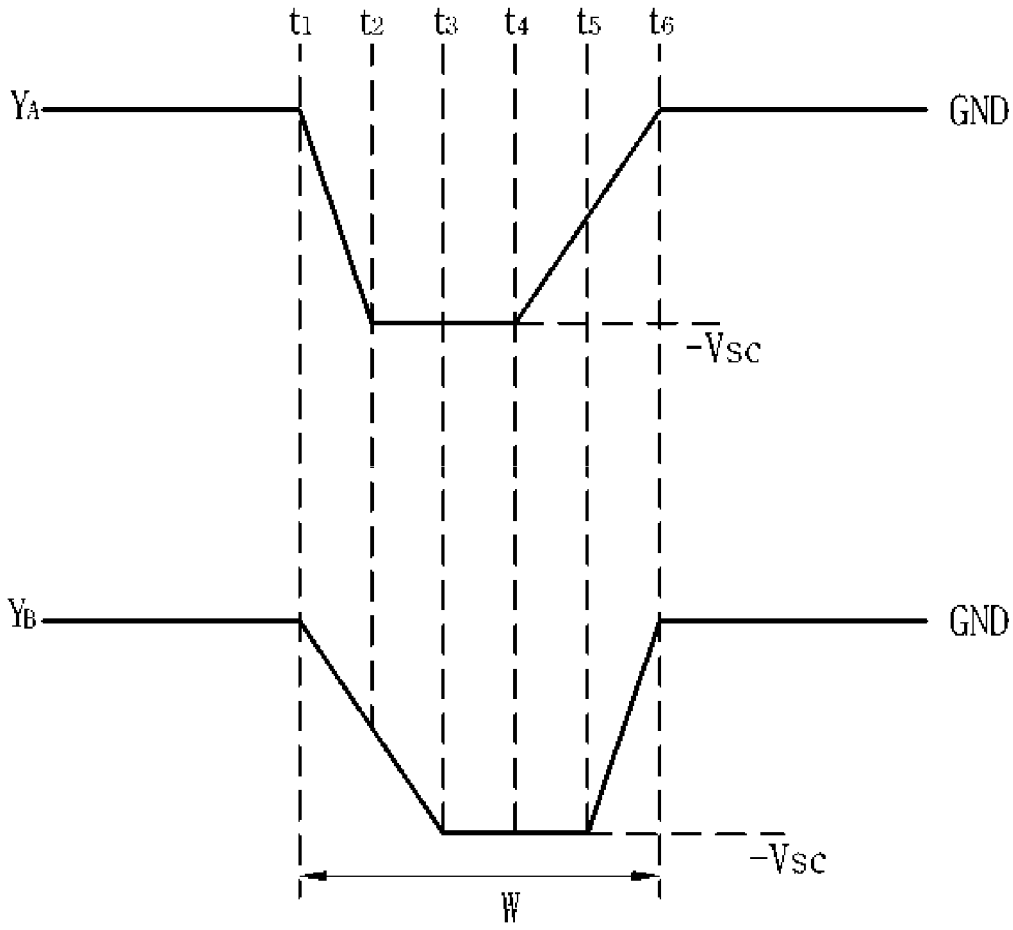
FIG. 18 illustrates a wave form generated by a driving method of plasma display apparatus in accordance with a ninth embodiment of the present invention.

FIG. 18 illustrates a wave form generated by a driving method of plasma display apparatus in accordance with a ninth embodiment of the present invention. The scan driver 102 in FIG. 1 supplies scan signals, of which at least one of the voltage falling time or the voltage rising time is from 20 ns to 150 ns, to different scan electrodes or scan electrode groups by control of the scan signal controller 104. The scan signals supplied to different scan electrodes or scan electrode groups have a constant width (W). As the different scan electrodes or scan signals supplied to the scan electrode groups have a constant width (W), the voltage rising time of each scan signal is short when the voltage falling time is long, and the voltage rising time of each scan signal is long when the voltage falling time is short.

For example, the width (W) of a scan signal supplied to a scan electrode or a scan electrode group YA and the width (W) of a scan signal supplied to another scan electrode or a scan electrode group YB are the same. Here, as the voltage falling time of a scan signal supplied to a scan electrode or a scan electrode group YA is t2-t1, while the voltage falling time of a scan signal supplied to another scan electrode or electrode group YB is T3-T1, and the voltage rising time of the scan signal supplied to a scan electrode or a scan electrode group YA is t6-t4, and the voltage rising time of a scan signal supplied to another scan electrode or electrode group YB is T6-T5, so that the voltage rising time of the scan signal is reduced when the voltage falling time of the scan signal is increased.

The width of the scan signal is maintained constantly even when the voltage rising time or the voltage falling time of the scan signal is modified, in order to generate address discharges in a stable manner. For instance, if the voltage rising time and the voltage falling time of a scan signal are reduced simultaneously such that the width of the scan signal is reduced excessively, the sustain time of address discharge is shortened excessively, whereupon the wall discharge in the discharge cell becomes insufficient and the sustain discharge in the sustain period is destabilized. Accordingly, the scan driver in FIG. 1 supplies a scan signal having a width sufficient for address discharge by control of the scan signal controller 104.

When each time section (t2-t1, t3-t2, t4-t3, t5-t4, t6-t5) is the same, as in FIG. 18, the sustain times of a scan voltage (−Vsc) supplied to a scan electrode or a scan electrode group YA and to another scan electrode or another electrode group YB are the same. Moreover, the sustain time of the scan voltage (−Vsc) supplied to the whole scan electrodes or the scan electrode group can be the same.

Figure 19:
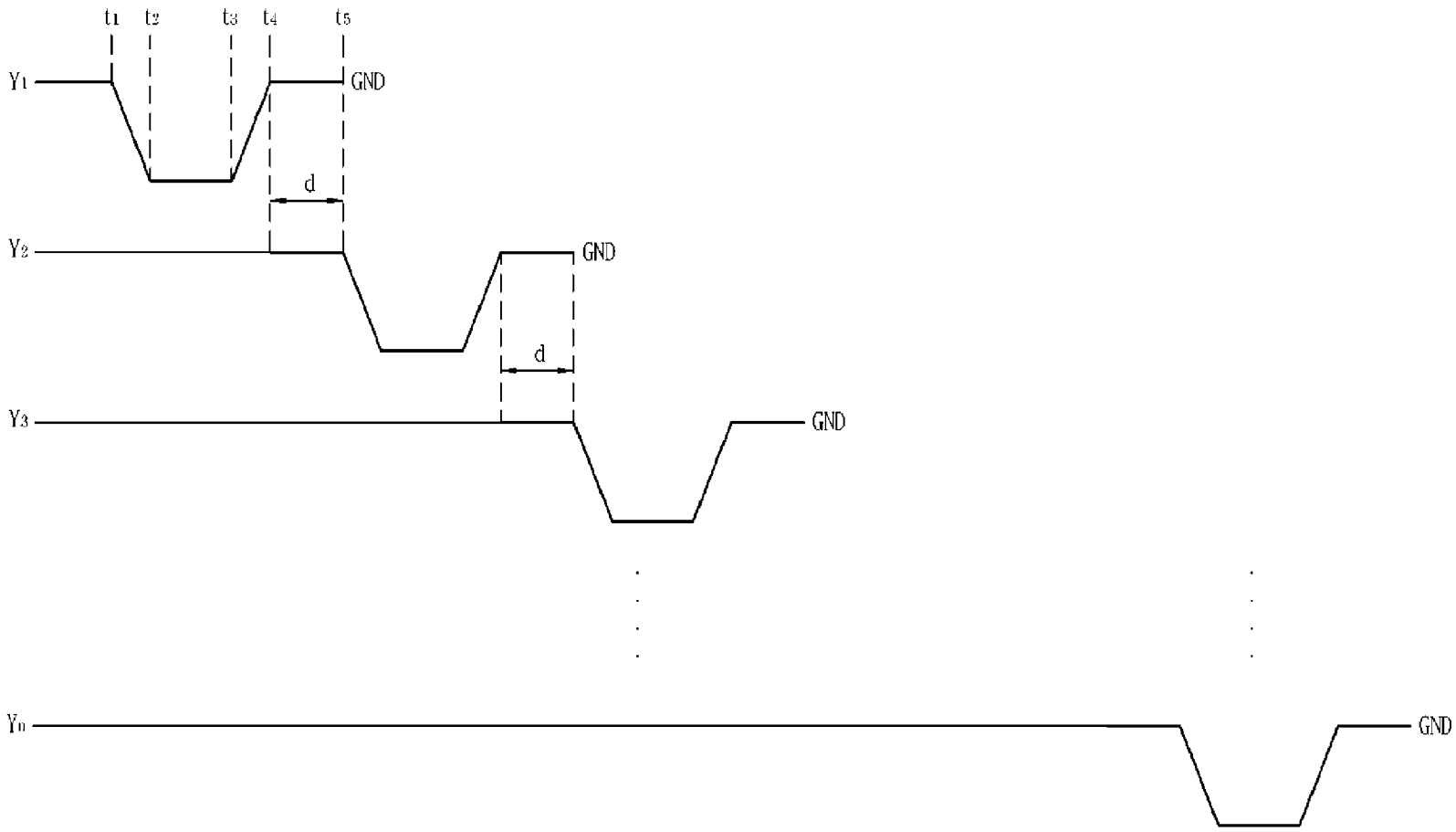
FIG. 19 illustrates a wave form generated by a driving method of plasma display apparatus in accordance with a tenth embodiment of the present invention.

FIG. 19 illustrates a wave form generated by a driving method of plasma display apparatus in accordance with a tenth embodiment of the present invention. As shown in FIG. 19, the scan driver 102 in FIG. 1 supplies scan signals, of which at least one of the voltage falling time or the voltage rising time is from 20 ns to 150 ns, to each scan electrode (Y1 to Yn) by control of the scan signal controller 104. When the scan signal is supplied each scan electrode (Y1 to Yn), the scan driver 102 outputs a scan signal at each supply time (d) by control of the scan signal controller 104. That is, the supply time (d) is the time difference between the supply ending time point (t4) of a scan signal supplied to two adjacent scan electrodes, and the supply starting time point (t5) of another scan signal.

The supply time (d) exists between the scan signals supplied to each two adjacent scan electrodes, in order to prevent undesired discharges between a discharge cell on a scan electrode and a discharge cell on an adjacent scan electrode.

The supply time (d) between the scan signals supplied to each scan electrode can be the same, and is from 20 ns to 1000 ns. It is also possible that the supply time (d) between the scan signals supplied to each scan electrode is different from each other.

Figure 20:
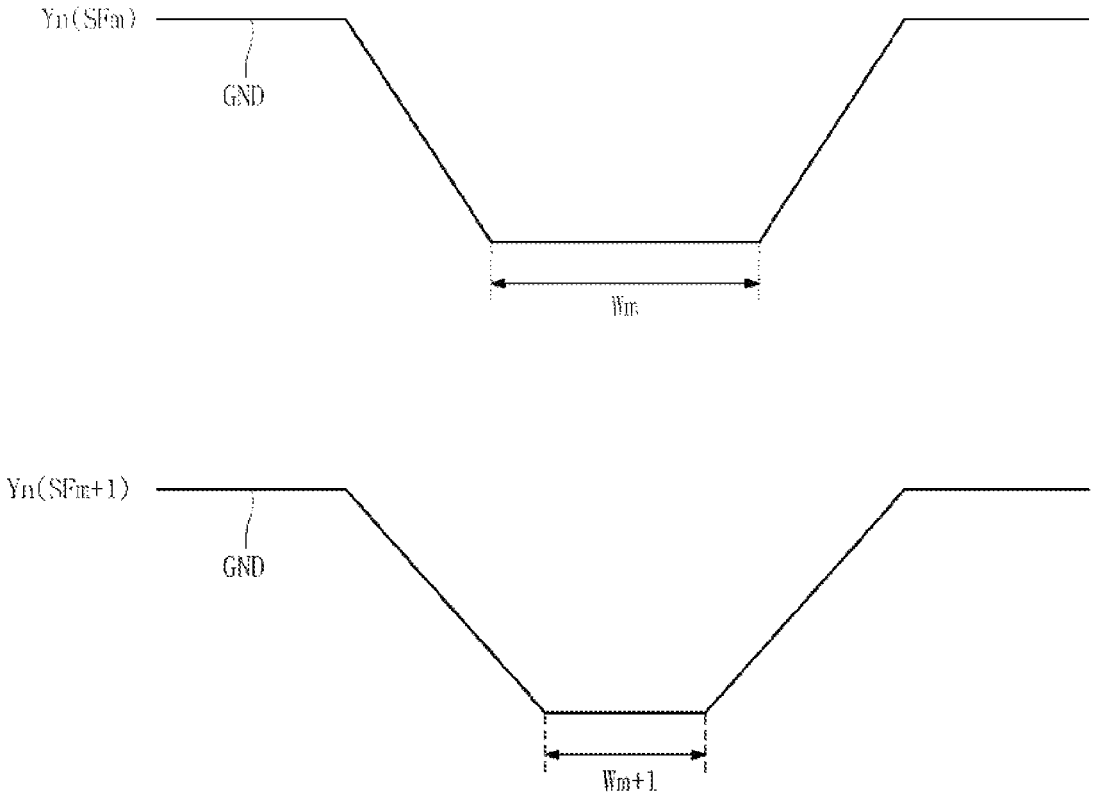
FIG. 20 illustrates a wave form generated by a driving method of plasma display apparatus in accordance with an eleventh embodiment of the present invention.

FIG. 20 illustrates a wave form generated by a driving method of plasma display apparatus in accordance with an eleventh embodiment of the present invention. As shown in FIG. 20, the scan driver 102 in FIG. 1 supplies scan signals, of which at least one of the voltage falling time or the voltage rising time is from 20 ns to 150 ns, to each scan electrode (Y1 to Yn) by control of the scan signal controller 104. In at least one subfield of total subfields, the scan driver 102 supplies the scan signal having a pulse width different from a pulse width of the scan signal supplied in the remaining subfields. For example, the pulse width ($W_m$) of the scan signal supplied in m th subfield is different from the pulse width ($W_{m+1}$) of the scan signal supplied in the (m+1)th subfield.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving method of a plasma display apparatus having a scan electrode and an address electrode, the method comprising:

supplying a falling voltage to the scan electrode during a first time so as to form a scan signal in an address period;

supplying a scan voltage sustained during a second time after the first time to the scan electrode so as to form the scan signal in the address period; and supplying a rising voltage to the scan electrode during a third time after the second time so as to form the scan signal in the address period, wherein at least one of the first time and the third time is from 20 ns to 150 ns, wherein the plasma display apparatus includes a plurality of scan electrode groups, and wherein each of the plurality of scan electrode groups includes one or more scan electrodes, a first time of a scan signal supplied to at least one of the plurality of scan electrode groups is different from a first time of a scan signal supplied to remaining ones of the plurality of scan electrode groups, or a third time of a scan signal supplied to at least one of the plurality of scan electrode groups is different from a third time of a scan signal supplied to remaining ones of the plurality of scan electrode groups.

2. The driving method of claim 1, wherein the first time and the third time in the address period are the same.

3. The driving method of claim 1, wherein a time difference between a supply ending time point of a first scan signal supplied to the scan electrode and a supply staffing time point of a second scan signal supplied to another scan electrode adjacent to the scan electrode is from 20 ns to 1000 ns.

4. The driving method of claim 1, wherein a first scan electrode, a second scan electrode adjacent to the first electrode, and a third scan electrode adjacent to the second electrode are formed in the plasma display apparatus, and wherein a time difference between a supply ending time point of a scan signal supplied to the first scan electrode and a supply starting time point of a scan signal supplied to the second scan electrode is different from a time difference between a supply ending time point of a scan signal supplied to the second scan electrode and a supply starting time point of a scan signal supplied to the third scan electrode.

5. The driving method of claim 1, wherein the scan electrode and an other scan electrode are formed in the plasma display apparatus, and wherein the second time of the scan voltage supplied to the scan electrode is different from the second time of the scan voltage supplied to the other scan electrode.

6. The driving method of claim 1, wherein a data signal corresponding to a scan signal supplied to the scan electrode is supplied to the address electrode, and the second time of the scan voltage is smaller than a sustain time of a data voltage of the data signal.

7. The driving method of claim 1, wherein a voltage rising time of a data signal corresponding to the scan signal and supplied to the address electrode is different from a voltage falling time of the data signal.

8. The driving method of claim 1, wherein the first time of the scan signal is different from a voltage rising time of a data signal supplied to the address electrode and corresponding to the scan signal.

9. The driving method of claim 1, wherein the third time of the scan signal is different from a voltage falling time of a data signal supplied to the address electrode and corresponding to the scan signal.

10. The driving method of claim 1, wherein the first time overlaps a time interval during which a data voltage of a data signal supplied to the address electrode and corresponding to the scan signal is sustained.

11. The driving method of claim 1, wherein a part of the third time overlaps a voltage falling time of a data signal supplied to the address electrode and corresponding to the scan signal.

12. The driving method of claim 1, wherein a number of scan electrodes in each of the plurality of scan electrode groups is the same.

13. The driving method of claim 1, wherein the number of scan electrodes in a first one of the plurality of scan electrode groups is different from a number of scan electrodes in a second one of the plurality of scan electrode groups.

14. The driving method of claim 1, wherein a difference between the first times or the third times of scan signals supplied to two of the plurality of scan electrode groups is constant.

15. The driving method of claim 1, wherein a sustain time of a scan voltage supplied to each of the plurality of scan electrodes is the same.

16. A driving method of a plasma display apparatus having a scan electrode and an address electrode, the method comprising:

supplying a falling voltage to the scan electrode during a first time so as to form a scan signal in an address period;

supplying a scan voltage sustained during a second time after the first time to the scan electrode so as to form the scan signal in the address period; and supplying a rising voltage to the scan electrode during a third time after the second time so as to form the scan signal in the address period, wherein at least one of the first time and the third time is from 20 ns to 200 ns, wherein the plasma display apparatus includes a plurality of scan electrode groups, and wherein each of the plurality of scan electrode groups includes one or more scan electrodes, a first time of a scan signal supplied to at least one of the plurality of scan electrode groups is different from a first time of a scan signal supplied to remaining ones of the plurality of scan electrode groups, or a third time of a scan signal supplied to at least one of the plurality of scan electrode groups is different from a third time of a scan signal supplied to remaining ones of the plurality of scan electrode groups.

17. The driving method of claim 16, wherein the scan signal supplied to the scan electrode is supplied in an address period of one or more of a plurality of subfields.

18. The driving method of claim 17, wherein the plurality of subfields include N number of subfields, a gray level weight of each subfield from the first subfield to the $N^{th}$ subfield increases, the one or more of the plurality of subfields include a first three of the plurality of subfields, and N is equal to or greater than 4.

* * * * *